US006896553B2

(12) United States Patent
Espenshade et al.

(10) Patent No.: US 6,896,553 B2
(45) Date of Patent: May 24, 2005

(54) ELECTRICAL CONNECTOR WITH AN INTEGRATED MODEM

(75) Inventors: Leonard K. Espenshade, Harrisburg, PA (US); Yakov Belopolsky, Harrisburg, PA (US); Charles Blichasz, Boiling Springs, PA (US); Kevin E. Walker, Hershey, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/882,004

(22) Filed: Jun. 29, 2004

(65) Prior Publication Data

US 2005/0070162 A1 Mar. 31, 2005

Related U.S. Application Data

(63) Continuation-in-part of application No. 10/672,148, filed on Sep. 25, 2003, now Pat. No. 6,755,685.

(51) Int. Cl.[7] ..... H01R 13/66
(52) U.S. Cl. ..... 439/620
(58) Field of Search ..... 439/620, 621

(56) References Cited

U.S. PATENT DOCUMENTS 4,363,941 A * 12/1982 Nelson ..... 200/1 R
4,674,809 A 6/1987 Hollyday et al.
5,069,641 A 12/1991 Sakamoto et al.
5,086,453 A * 2/1992 Senoo et al. ..... 379/93.09
5,134,648 A * 7/1992 Hochfield et al. ..... 379/93.29
5,822,692 A * 10/1998 Krishan et al. ..... 455/419
6,654,817 B1 11/2003 Huang

* cited by examiner

*Primary Examiner*—Ross Gushi
*Assistant Examiner*—James R. Harvey
(74) *Attorney, Agent, or Firm*—Wei Te Chung

(57) ABSTRACT

An electrical connector (100) for being mounted on a motherboard, includes an insulative housing (1) having a front mating face providing a receiving cavity (111) extending rearwardly thereinto, an internal circuit board (31) containing a safety insulating and filtering circuitry and a telephone line-side modem controller (33), a pair of conductive contacts (2) retained to the insulating housing, and a number of footer contacts (32) connected with the internal circuit board for connecting to the motherboard. The safety insulating and filtering circuitry and the telephone line-side modem controller perform partial functions of a modem card assembly. The conductive contacts electrically connect with the internal circuit board and extend into the receiving cavity for contacting with a complementary connector.

20 Claims, 15 Drawing Sheets

ELECTRICAL CONNECTOR WITH AN INTEGRATED MODEM

CROSS-REFERENCE TO RELATED APPLICATION

This application is a continuation-in-part of U.S. patent application Ser. No. 10/672,148, now U.S. Pat. No. 6,755,685, filed on Sep. 25, 2003, entitled "ELECTRICAL CONNECTOR WITH IMPROVED CONTACTS", and assigned to the common assignee.

BACKGROUND OF THE INVENTION

1. Field of the Invention

The present invention relates to an electrical connector and more particularly, to an electrical connector being mounted onto a circuit board.

2. Description of the Prior Art

Electrical apparatus, such as personal computers and personal information managers, are becoming increasingly dependent upon their ability to electrical communicate or share information with other electrical apparatus. There are two important ways for isolate electrical apparatus associates with each other. One way is connected to a network system, and the other way is coupling with a modem for access over telephone lines.

FIG. 13 shows a conventional computer peripheral design, wherein a computer 200 is connected to LAN card 400 through a USB (universal series bus) 300 to access LAN (Local Area Network). The LAN card has a modem integrated therein. That is to say, the LAN card is a modem card assembly in fact.

FIG. 14 shows another conventional computer peripheral design, wherein a computer 200' is connected to a Modem 500' through a USB (universal series bus) and a first modem cable, and uses the modem 500' to access network through a second modem cable and telephone line.

FIG. 15 shows the main functions of every Modem. In a state-of-the-art design most of the hardware features of a Modem are contained on a separate modem card assembly that is depicted as rectangular with a dashed line border. Such a modem card assembly typically contains two modem controllers A and B. The controllers are located on two sides of a safety insulation barrier that prevents dangerous voltages reaching the equipment or operators. The safety insulation barrier typically comprises of insulation transformer and high voltage capacitors. In addition to that, the insulation barrier may include resistive, capacitive or inductive electrical components forming an electromagnetic filter. Since the transmission signals often contain the digitally coded information, the said filter is called a digital filter, and the combined feature is called a Digital Insulation Barrier.

As shown in FIG. 16, the conventional Modem Card Assembly requires at least four connectors. Wherein a motherboard connector part 1 and part 2 are a mating pair connecting to the Modem Card Assembly to a motherboard. A modular jack connector is provided to connect the Modem Card Assembly to the telephone line. It is clearly that such arrangement needs more connectors and the cost is relative high. Moreover, the motherboard needs to provide additional space for mounting the motherboard connector part 1 thereon, thereby increasing the size of the motherboard.

U.S. Pat. No. 5,069,641, issued to Sakamoto on Dec. 3, 1991, discloses a modular jack assembly in which a choke coil and terminals are soldered to a PCB. This PCB subassembly is then encased in an insulative housing. As the size of the equipment in which the connectors are installed decreases, the density of the connectors positioned on a motherboard of the applicant must increase and all the dimensions of the connectors must be minimized. However, it would be difficult or impossible to accomplish in blind assembly operations, and/or in soldering operation as the size of the connector is reduced. It is therefore essential that the performance and the electrical characteristics of the connector not compromised or diminish as the size of the connector decreased.

Hence, an electrical connector with an integrated modem is desired.

SUMMARY OF THE INVENTION

An object of the present invention is to provide an improved electrical connector with an integrated modem.

Another object of the present invention is to provide an improved electrical connector having an internal circuit board which can conveniently and securely have contacts mounted thereon.

An electrical connector for being mounted on a motherboard, includes an insulative housing having a front mating face providing a receiving cavity extending rearwardly thereinto, an internal circuit board containing a safety insulating and filtering circuitry and a telephone line-side modem controller, a pair of conductive contacts retained to the insulating housing, and a number of footer contacts connected with the internal circuit board for connecting to the motherboard. The safety insulating and filtering circuitry and the telephone line-side modem controller perform partial functions of a modem card assembly. The conductive contacts electrically connect with the internal circuit board and extend into the receiving cavity for contacting with a complementary connector.

Other objects, advantages and novel features of the invention will become more apparent from the following detailed description when taken in conjunction with the accompanying drawings.

DETAILED DESCRIPTION OF THE INVENTION

The present invention will be discussed hereafter in detail in terms of the preferred embodiment of the present invention with reference to the accompanying drawings. In the following description, numerous specific details are set for the in order to provided a thorough understanding of the present invention. It will be obvious, however, to those skilled in the art that the present invention may be practiced without these specific detail. In other instances, well-known structures are not shown in detail in order to avoid unnecessary obscurity of the present invention.

Figure 1:
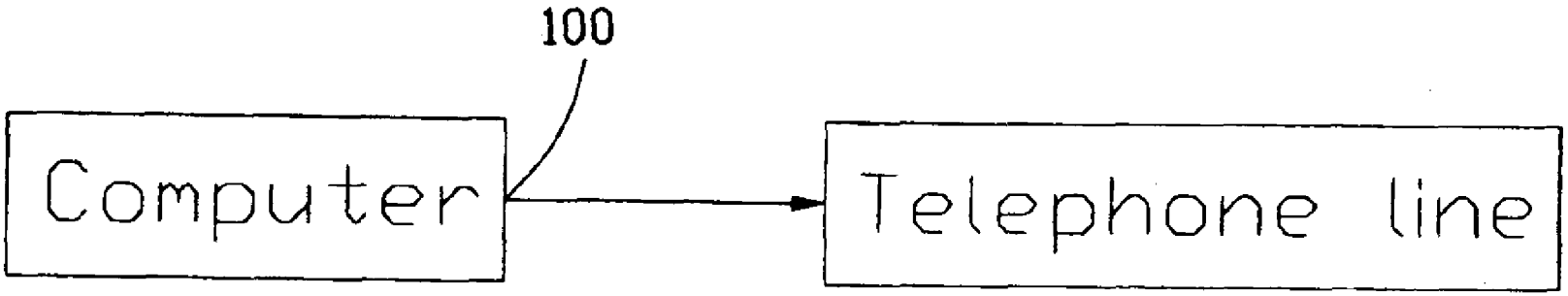
FIG. 1 shows an electrical equipment peripheral design according to the present invention, wherein the electrical equipment has an electrical connector with an integrated modem accessing network through telephone line.

Referring to FIG. 1, an electrical equipment (not labeled), such as a computer, according to the present invention comprises a motherboard and an electrical connector 100 mounted on the motherboard and exposed to access network through telephone line. The electrical connector 100 performs partial functions of an exiting Modem Card Assembly.

Figure 2:
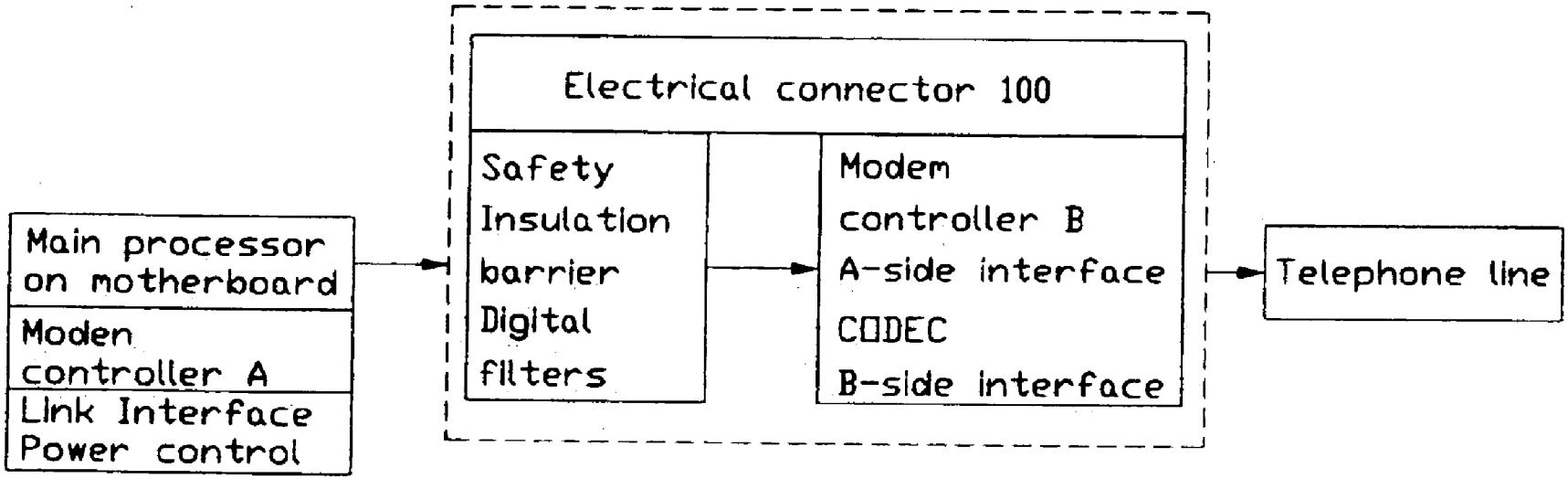
FIG. 2 shows an internal architecture of the integrated Modem peripheral according to the present invention.
Figure 11:
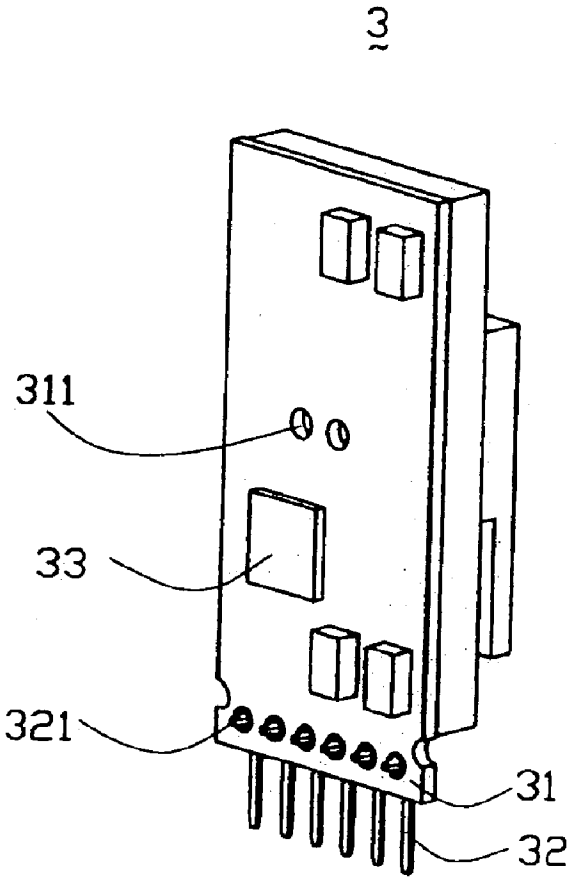
FIG. 11 is a perspective view of an insert module of the electrical connector.

As best showing in FIG. 2 in conjunction with FIG. 11, in the preferred embodiment of the invention, a Digital Insulation Barrier (combination of a Safety Insulation Barrier and Digital Filters) and a Modem Controller B are combined inside the electrical connector 100. For convenience, such Digital Insulation Barrier and the Modem Controller B integrated in the electrical connector 100 are referred to hereafter as modem components 33 (shown in FIG. 11). It should be noted that the existing Modem Card Assembly is eliminated. The electrical connector 100 is mounted on the motherboard. At the same time functions of the Modem Controller A are moved onto the motherboard and associated with the modem components 33 of the electrical connector 100. Therefore, the main processor on the motherboard can access network directly through the electrical connector 100 and the telephone line. As a result the need in motherboard connectors is eliminated, additional significant cost reduction is achieved by reducing the size of the motherboard. It also should be noted that the Digital insulation barrier and the modem controller A may selectively both be incorporated onto the motherboard, while only the controller B is integrated into the electrical connector 100.

Figure 3:
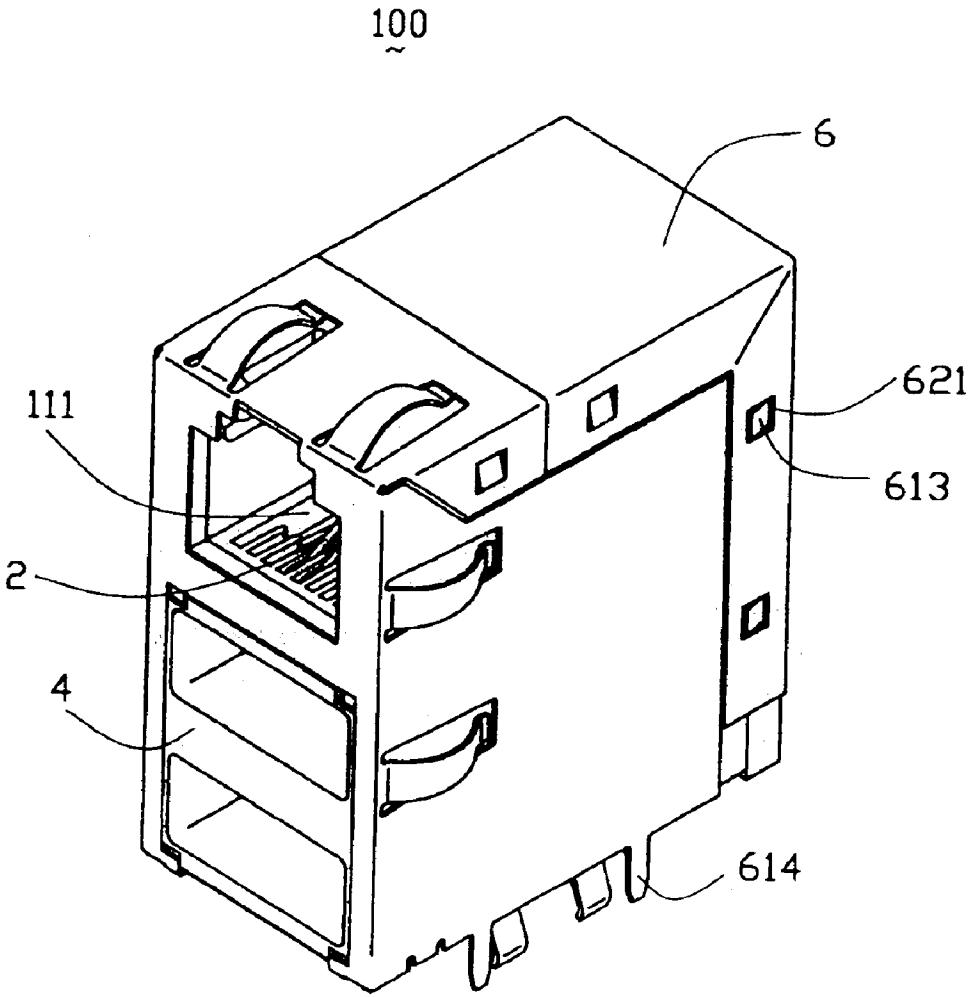
FIG. 3 is a perspective view of the electrical connector shown in FIG. 1.
Figure 4:
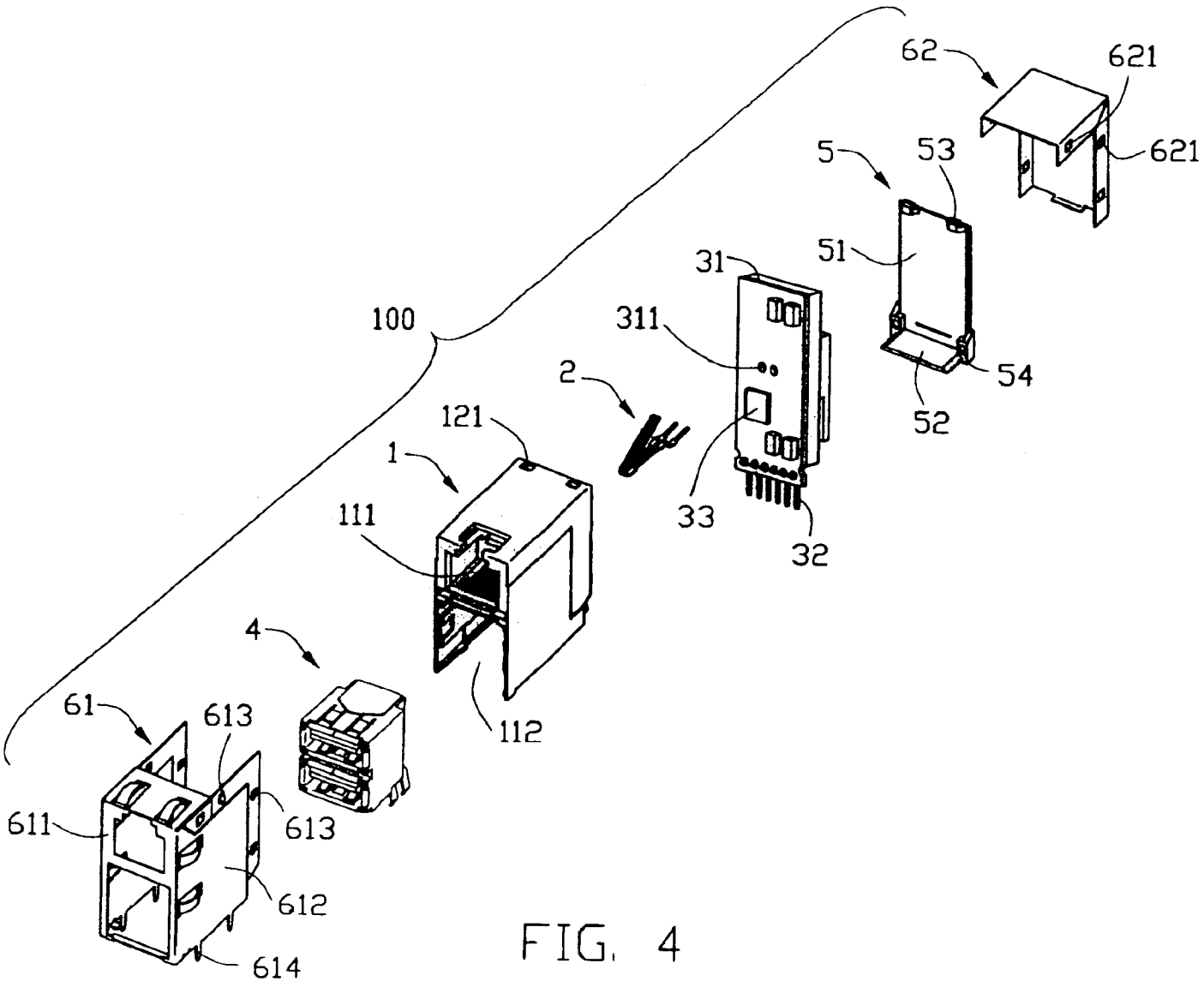
FIG. 4 is an exploded view of FIG. 3.
Figure 5:
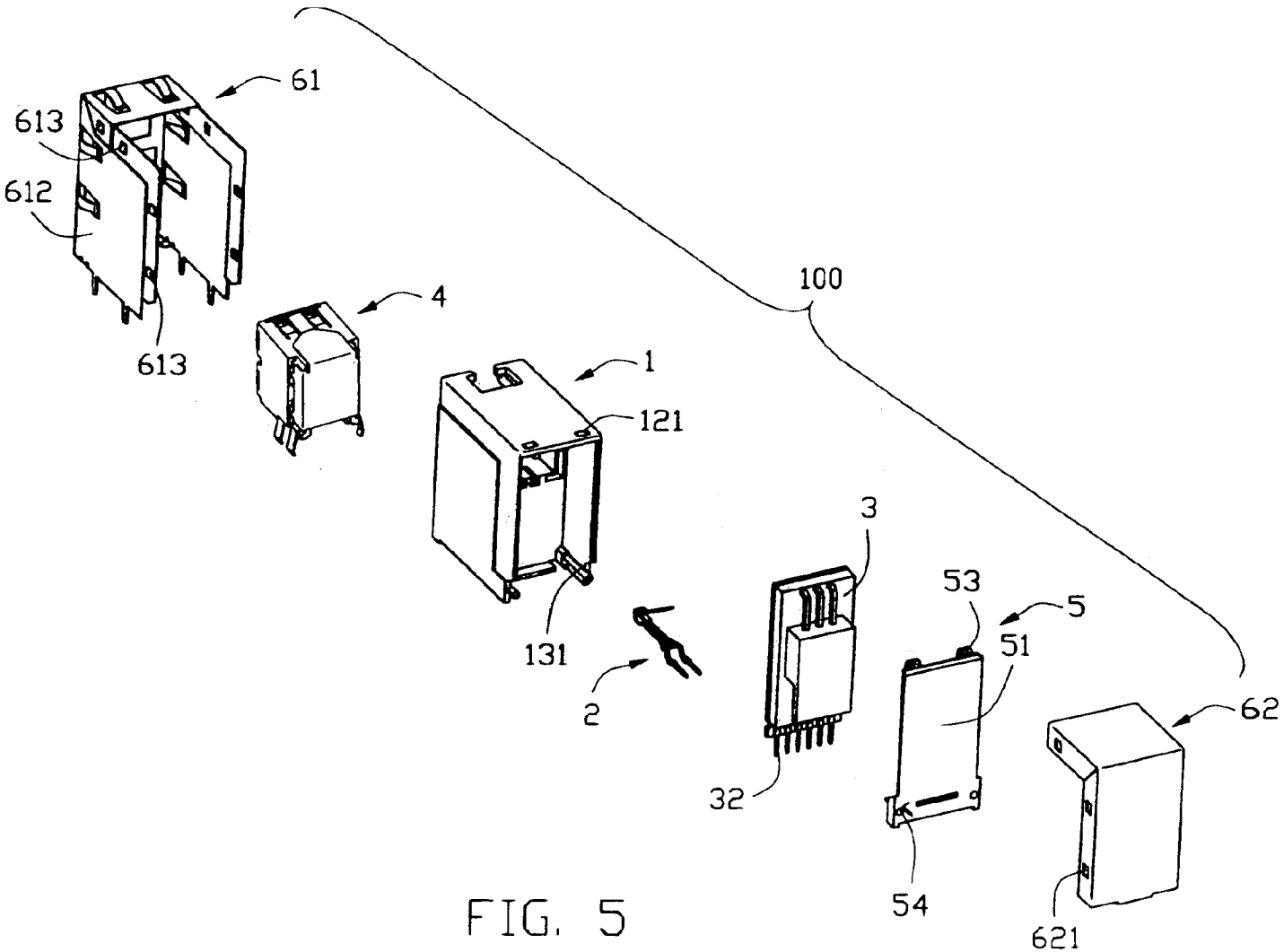
FIG. 5 is another exploded view of FIG. 3.

Referring to FIGS. 3, 4 and 5, the electrical connector 100 includes an insulative housing 1, a plurality of conductive contacts 2 retained in the housing 1, an electrical element 3 containing the modem component 33 performing partial functions of the existing Modem Card Assembly, a connector module 4 (shown in FIG. 4), a plastic rear cover 5 and an outer shell 6 substantially surrounding and shielding the housing 1.

Figure 6:
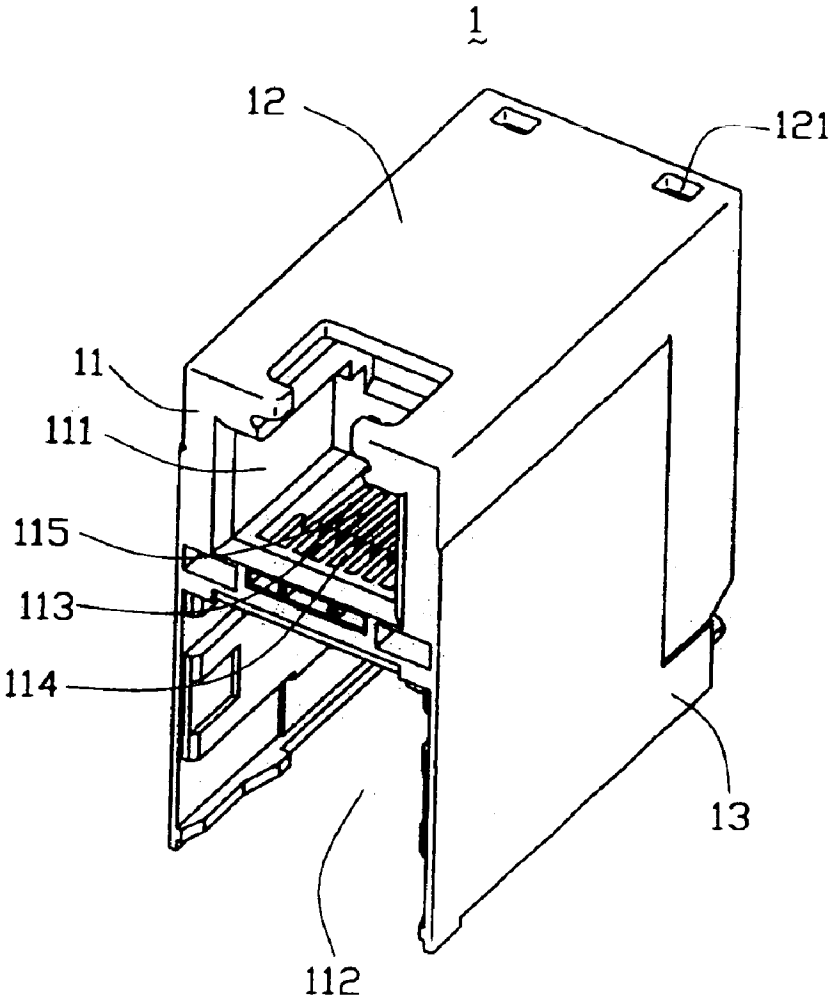
FIG. 6 is a perspective view of an insulative housing of the electrical connector.
Figure 7:
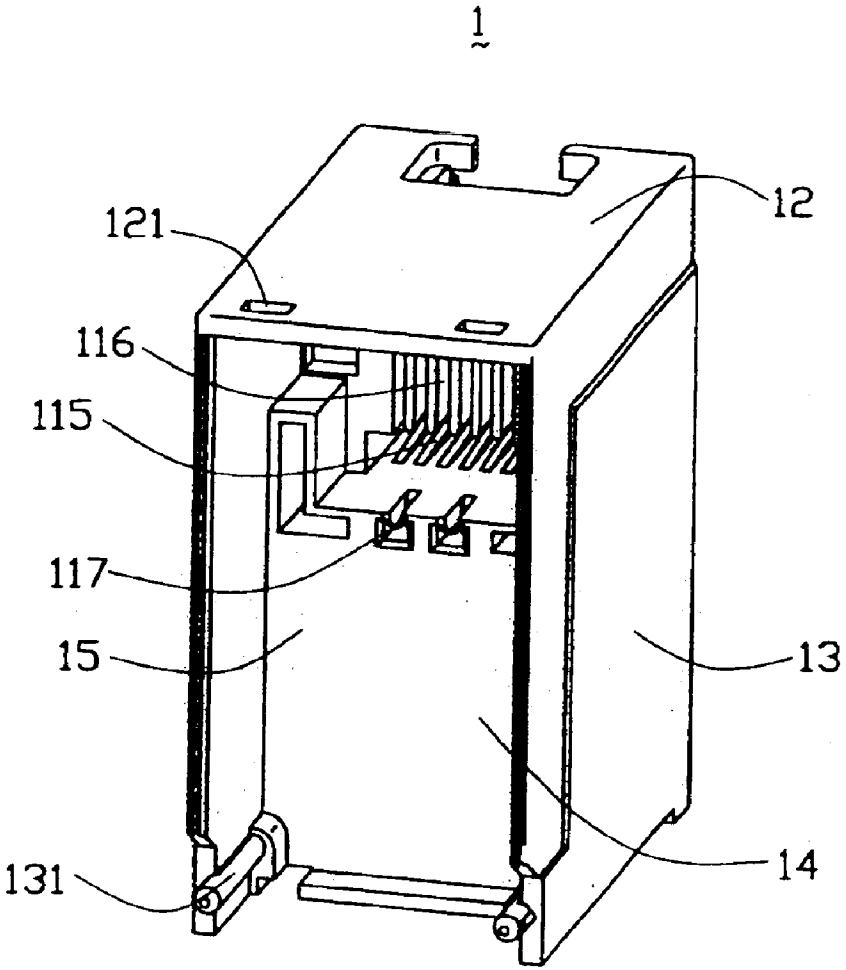
FIG. 7 is another perspective view of FIG. 6.

Referring to FIGS. 6 and 7, the insulative housing 1 includes a mating face 11, an upper wall 12, two sidewalls 13 and a rear opening 14. The mating face 11 provides upper and lower cavities 111, 112 extending rearwardly thereinto. The rear opening 14 shares a panel 15 with the lower cavity 112. In the embodiment illustrated, the upper cavity 111 is a modular plug-receiving cavity for mating with a modular plug connector, and the lower cavity 112 is provided for receipt thereinto of the connector module 4. The upper cavity 111 provides a plurality of barriers 113 projecting inwardly from the mating face 11, and a number of ramps 115 essentially aligned with and spaced from corresponding barriers 113 in a longitudinal direction, thereby forming a plurality of parallel slots 114 between the adjacent barriers 113 and the ramps 115 in a front-to-rear direction for receiving corresponding contacts 2. A plurality of grooves 117 are dimensioned to be positioned proximate the panel 15 and communicating with the rear opening 14 for receiving the contacts 2. The housing 1 further includes a plurality of comb passages 116 extending into the upper cavity 111 and communicating with the rear opening 14. The upper wall 12 defines a pair of locking holes 121 far from the mating face 11. Each sidewall 13 has a shaft 131 projecting inwardly from a bottom portion thereof for engaging with the plastic rear cover 5.

Figure 8:
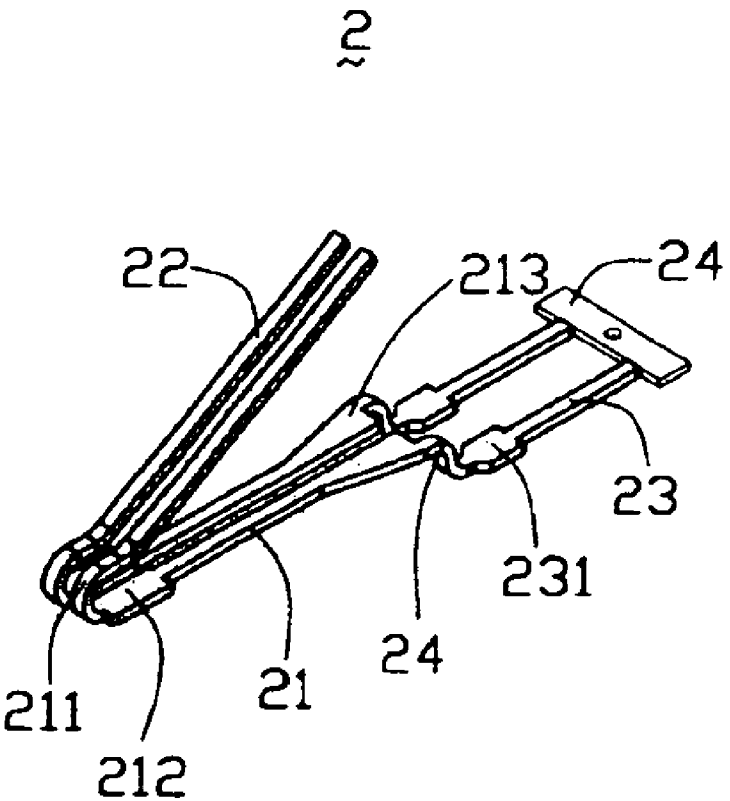
FIG. 8 is a perspective view of conductive contacts attached to a carrier strip of the electrical connector.

As best shown in FIG. 8, the conductive contacts 2 are initially attached to a carrier strip 24. Each conductive contact 2 includes a base portion 21 having a front nose 211 on a front section thereof, a contacting portion 22 upwardly and rearwardly extending from the front nose 211 of the base portion 21 and a tail portion 23 connected to the carrier strip 24. The base portion 21 has a pair of shoulders 212 adjacent to the front nose 211 and extending transversely from opposite sides thereof. The base portion 21 further has an enlarged section 213 apart from the front nose 211 and extending transversely and outwardly. The tail portion 23 is integrally attached to the enlarged section 213 by a transition bight 24. The tail portion 23 downwardly offsets from the transition bight 24 and is parallel to the base portion 21. The tail portion 23 has a positioner section 231 extending from opposite sides thereof adjacent to the transition bight 24.

Figure 12:
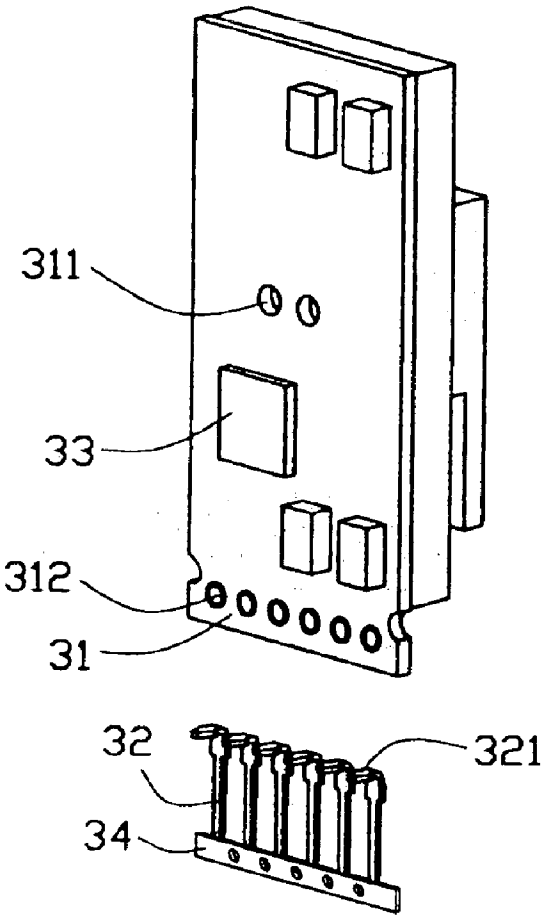
FIG. 12 is an exploded view of FIG. 11.
Figure 13:
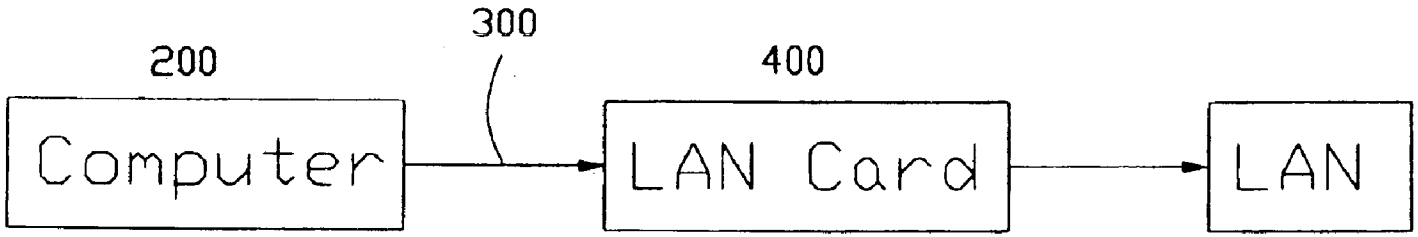
FIG. 13 (PRIOR ART)
FIG. 13 shows a conventional computer peripheral design, wherein a computer is connected to a LAN card through a USB (universal series bus) to access LAN (Local Area Network)
Figure 14:
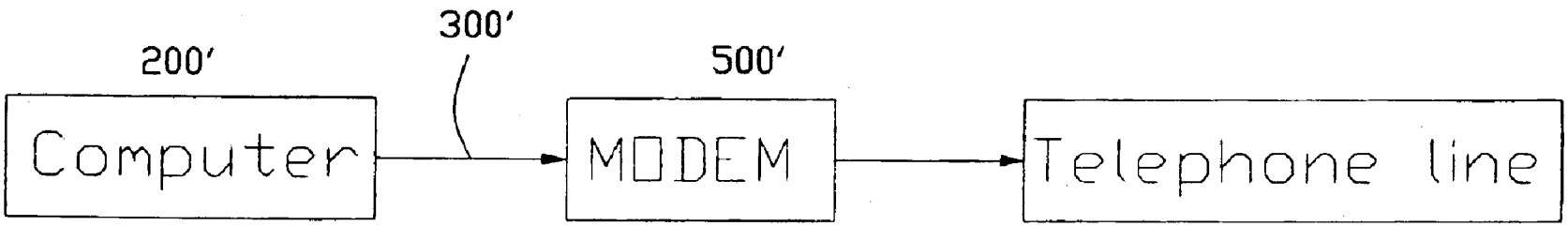
FIG. 14 (PRIOR ART)
FIG. 14 shows another conventional computer peripheral design, wherein a computer is connected to a MODEM through a USB (universal series bus), and uses the MODEM to access network through telephone line.
Figure 15:
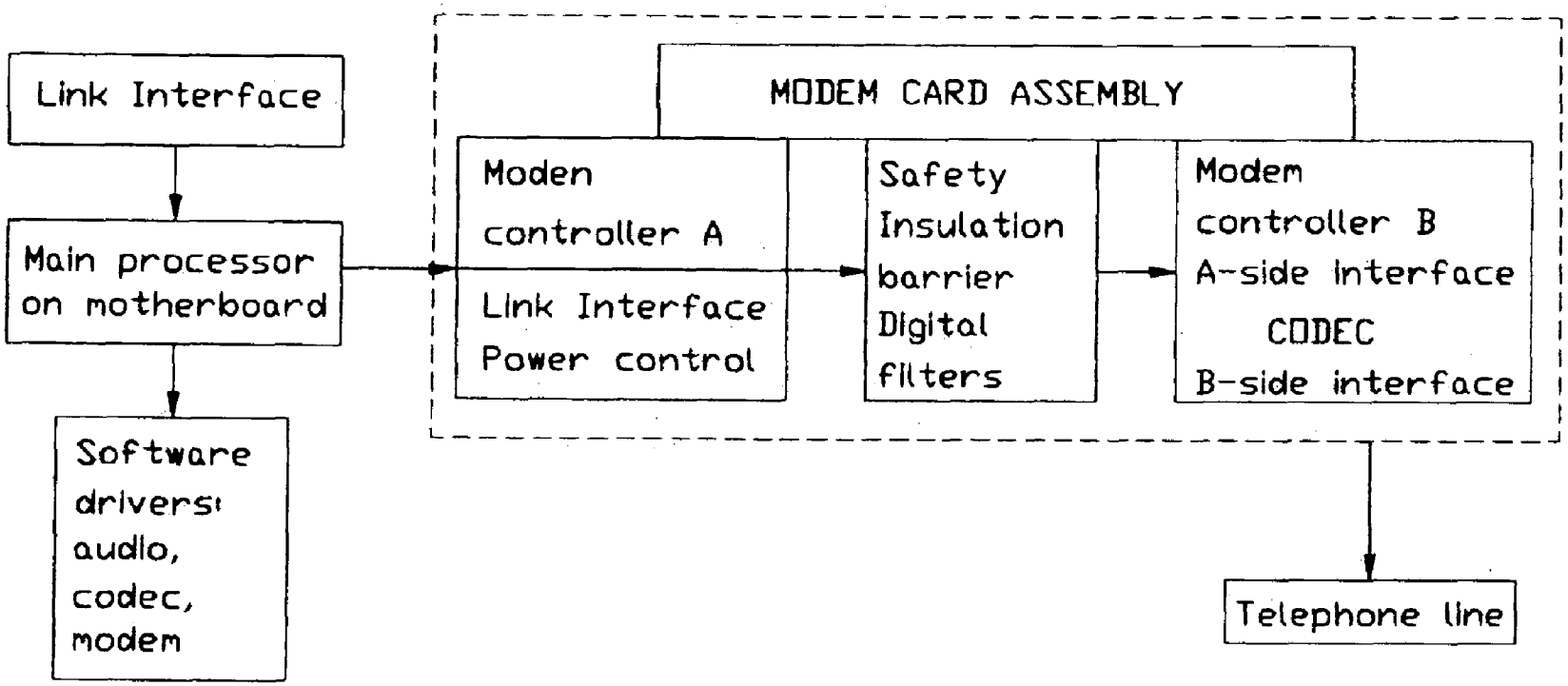
FIG. 15 (PRIOR ART)
FIG. 15 shows an internal architecture of a conventional Modem Card Assembly peripheral design.
Figure 16:
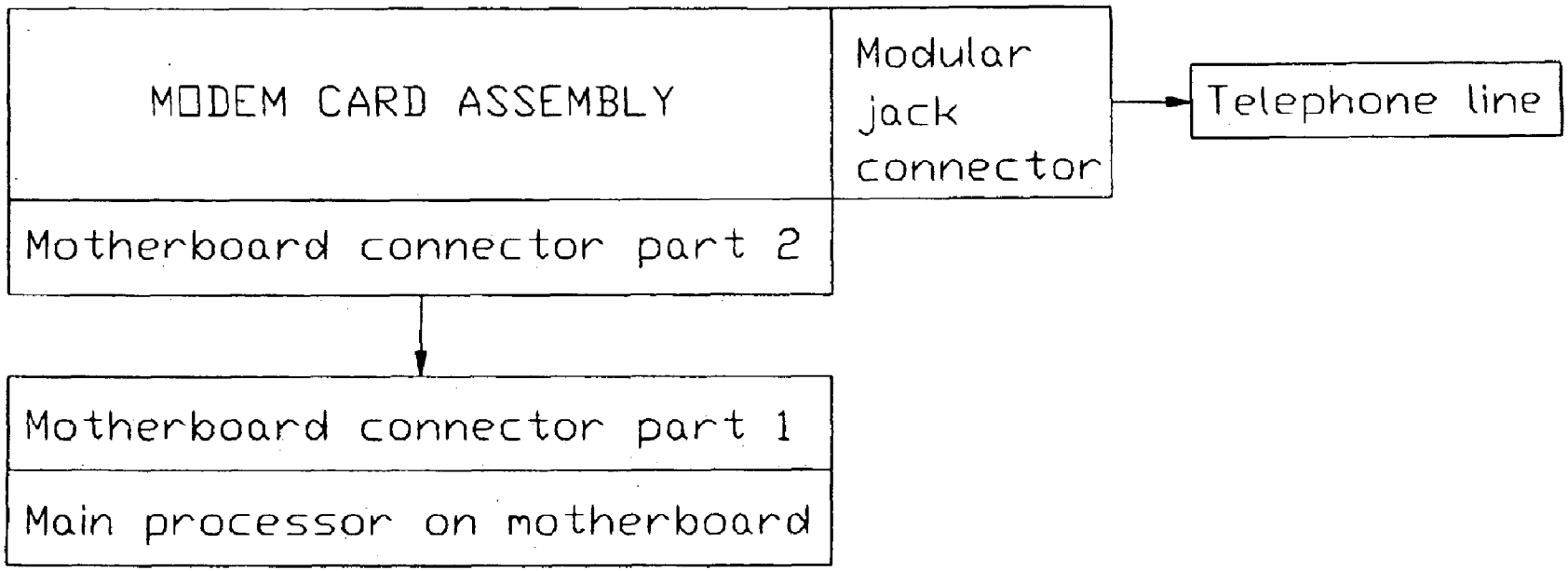
FIG. 16 (PRIOR ART)
FIG. 16 shows a conventional Modem Card Assembly peripheral design.

Referring to FIGS. 11 and 12, the electrical element 3 includes an internal circuit board 31 carrying the modem components 33 and a plurality of footer contacts 32 thereon. The internal circuit board 31 provides a plurality of pinouts 311 on a substantial middle portion thereof for respectively receiving the contacts 2 and a plurality of footer holes, 312 in a lower portion thereof. Each footer contact 32 has a latch beam 321 extending horizontally from a top portion thereof and interferentially fitted in the corresponding footer holes 312. It should be noted that the footer contacts 32 are initially attached to a carrier strip 34. The carrier strip 34 is removed from the footer contacts 32 after or before the footer contacts 32 are installed in the internal circuit board 31 and soldering thereto. The internal circuit board 31 further has a number of signal conditioning components mounted thereon (not labeled). Such signal conditioning components can be passive electrical components such as transformers, resistors, capacitors and as such, and active components such as varistors, thyristors, transistors and integrated circuits, and electromechanical components such as switches, relays, indicators and transient voltage suppressors.

Referring to FIGS. 4 and 5, the plastic rear cover 5 includes a vertical portion 51 and a horizontal portion 52 extending forwardly from a bottom side of the vertical portion 51. The vertical portion 51 includes a pair of projections 53 extending from a top end thereof and a pair of fixing portions 54 formed near opposite sides of a bottom end thereof. The projections 53 are provided for latching within the locking holes 121 of the housing 1, respectively. The fixing portions 54 are provided for engaging with the corresponding shafts 131 of the housing 1.

The outer shell 6 is stamped from a sheet of conductive material and includes a front shell 61 and a rear shell 62 which mount together to define an interior space for enclosing the housing 1. The front shell 61 includes a front plate 611 providing two windows (not labeled) respectively corresponding to the upper and lower cavities 111, 112, and two side plates 612. Each side plate 612 has a plurality of embossments 613 and a plurality of grounding tabs 614 extending downwardly from a bottom end thereof. The rear shell 62 has a number of apertures 621 corresponding to and engaging with respective ones of the embossments 613.

Figure 9:
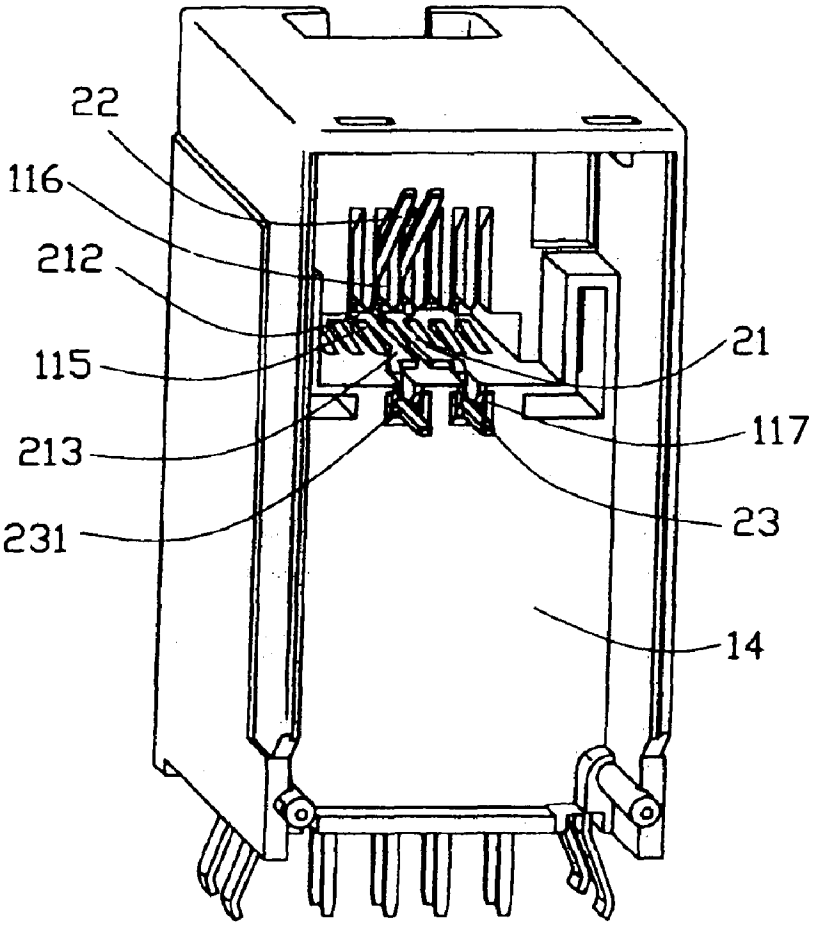
FIG. 9 is a partially assembled view of FIG. 4 showing the contacts assembled within the insulative housing taken from back aspect.
Figure 10:
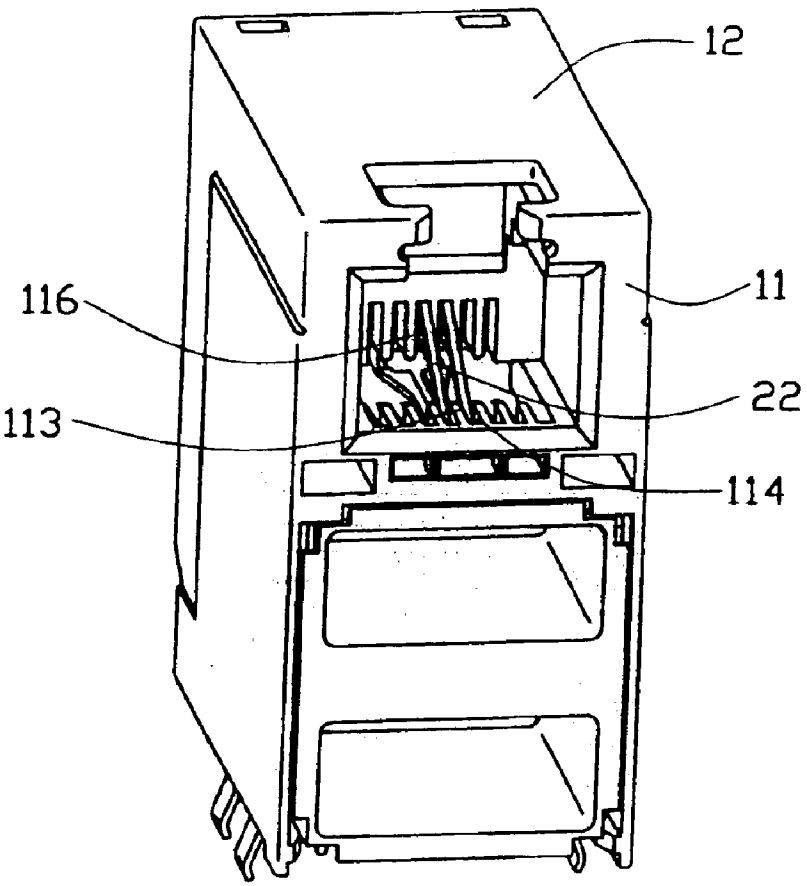
FIG. 10 is another partially assembled view of FIG. 4 showing the contacts and a connector module assembled within the insulating housing taken from front aspect.

Referring to FIGS. 9 and 10 in conjunction with FIG. 8, in assembly, the conductive contacts 2 are installed in the housing 1 from the rear opening 14. The front nose 211 of each contact 2 extends through respective one of the passages 116 and is received in the corresponding slot 114. The contacting portion 22 of each contact 2 is exposed in the upper cavity 111 with a free end deflected by the corresponding passage 116, thereby having a preload force. The base portion 21 and the front nose 211 of each contact 2 are held in the slot 114. The shoulders 212 of each contact 2 are latched with the raised ramps 115, in conjunction with the contact preload force which keeps a constant downward force on the contacts 2, thereby assuring that the contacts 2 don't lift off the shoulders at the end of the ramps. The positioner sections 231 of the contacts 2 are received in the grooves 117. Therefore, the contacts 2 are securely embedded in the housing 1. After installation, the carrier strip 24 is removed from the contacts 2.

Referring to FIGS. 4 and 5 in conjunction with FIG. 3, the electrical element 3 is attached to the housing 1 from the rear opening 14. The tail portion 23 of each contact 2 extends beyond the grooves 117 and into the respective one of the pinout 311 of the internal circuit board 31. The plastic rear cover 5 is coupled to the housing 1. The shafts 131 of the housing 1 are installed in the fixing portion 54 of the plastic rear cover 5. The projections 53 of the plastic rear cover 5 are received in the corresponding locking holes 121 of the housing 1, thereby stabilizing the connection between the contacts 2 and the internal circuit board 31. The connector module 4 such as a dual USB module for mating with USB type plugs, is assembled to the lower cavity 112 of the housing 1 from the mating face 11. The structure and the function of the connector module 4 is well known to those skilled in the art, a detailed description thereof is omitted herefrom. The outer shell 6 substantially surrounds the housing 1. The front plate 611 of the front shell 61 affixes along the mating face 11 of the housing 1. The embossments 613 are interference fitted in the respective one of the apertures 621. The grounding tabs 614 are soldered to the corresponding grounding holes (not shown) of the motherboard.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. A modular electrical connector for being mounted on a motherboard, comprising:

an insulative housing having a front mating face providing a receiving cavity extending rearwardly thereinto;

an internal circuit board containing a safety insulating and filtering circuitry and a telephone line-side modem controller, the safety insulating and filtering circuitry and the telephone line-side modem controller performing partial functions of a modem card assembly;

a pair of conductive contacts retained to the insulative housing, the conductive contacts electrically connecting with the internal circuit board and extending into the receiving cavity for contacting with a complementary connector; and a plurality of footer contacts connected with the internal circuit board for connecting to the motherboard.

2. The modular electrical connector according to claim 1, wherein the motherboard contains a motherboard-side modem controller mounted thereon performing the other functions of the modem card assembly.

3. The modular electrical connector according to claim 1, wherein the safety insulating and filtering circuitry includes insulation transformer, high voltage capacitors, and resistive, capacitive or inductive electrical components performing as an electromagnetic filter.

4. The modular electrical connector according to claim 1, wherein the conductive contact includes a base portion having a front nose in a front portion thereof, a contacting portion angled rearwardly from the front nose, and a board mounting portion extending from a rear portion of the base portion.

5. The modular electrical connector according to claim 4, wherein the internal circuit board has a pinout therein, and wherein the board mounting portion of the conductive contact extends into the pinout and electrically connects with the internal circuit board.

6. The modular electrical connector according to claim 5, wherein the internal printed circuit board is connected to the board mounting portion of the conductive contact in a substantially perpendicular manner.

7. The modular electrical connector according to claim 4, wherein the housing has a comb passage communicating with the receiving cavity and deflecting the contacting portion to provide a downward force on the conductive contact.

8. The modular electrical connector according to claim 1, wherein the internal circuit board has a plurality of signal conditioning components mounted thereon.

9. The modular electrical connector according to claim 8, wherein the signal conditioning components can be passive electrical components such as transformers, resistors, capacitors and as such, and active components such as varistors, thyristors, transistors, integrated circuits, and electromechanical components such as switches, relays, indicators, and transient voltage suppressor.

10. The modular electrical connector according to claim 1, further including a plastic rear cover attached to the housing with the insert module sandwiched therebetween.

11. The modular electrical connector according to claim 10, wherein the plastic rear cover has a projection extending from a top end thereof, and wherein the housing defines a locking hole for receiving the projection.

12. The modular electrical connector according to claim 10, wherein the plastic rear cover has a fixing portion, and wherein the housing includes a shaft projecting inwardly from a bottom portion thereof engaging with the fixing portion of the rear cover.

13. The modular electrical connector according to claim 1, further including an outer shell affixed around the housing.

14. The modular electrical connector according to claim 1, further including a stacked connector.

15. The modular electrical connector according to claim 14, wherein the stacked connector is a USB (Universal Serial Bus) type connector for mating with a USB type plug.

16. An electrical connector assembly comprising:

a motherboard;

an electrical connector mounted on the motherboard, the electrical connector including an insulative housing; an internal circuit board retained to the insulative housing; a pair of conductive contacts assembled within the insulative housing and connecting with the internal circuit board for contacting with a complementary connector; and a plurality of footer contacts connected with the internal circuit board for connecting to the motherboard; and a modem replacing an existing modem card assembly in functionality, the modem including first and second modem parts, the first modem part being mounted on the internal circuit board of the electrical connector performing partial functions of the modem card assembly, the second modem part being mounted onto the motherboard and incorporated with the first modem part to performing the whole modem functions.

17. The electrical connector assembly according to claim 16, wherein the first modem part is substantially a telephone line-side modem controller, and the second modem part is substantially a motherboard-side modem controller.

18. The electrical connector assembly according to claim 16, wherein the modem further includes a safety insulating and filtering circuitry is selectively combined inside of the electrical connector or mounted on the motherboard.

19. An electrical modem system comprising:

a first section including a mother board with a first modem controller thereof;

a second section including a modular jack with therein an internal printed circuit board having a second modem controller mounted thereon, said first section and said second section being mechanically and electrically connected to each other via said modular jack mounted to the mother board; and a telephone line which is connected to the modular jack through a plug.

20. The system according to claim 19, wherein said modular jack includes a pair of terminals mechanically and electrically connected to the plug, and further connected to the internal printed circuit board.

* * * * *